United States Patent [19]

Sharma

[11] Patent Number: 4,593,906

[45] Date of Patent: Jun. 10, 1986

[54] SURFACE GAME PROJECTILE MANIPULATING DEVICE

[76] Inventor: Devendra N. Sharma, 22, Carroll House, Gloucester Terrace, London W2 3PR, Great Britain

[21] Appl. No.: 477,840

[22] Filed: Mar. 28, 1983

Related U.S. Application Data

[63] Continuation of Ser. No. 188,129, Sep. 17, 1980, abandoned.

[30] Foreign Application Priority Data

Sep. 17, 1979 [GB] United Kingdom ..... 7932145

[51] Int. Cl.[4] ..... A63B 71/00

[52] U.S. Cl. ..... 273/129 R; 273/129 AP; 273/129 V; 280/12.13; 272/35

[58] Field of Search ..... 273/129 AP

[56] References Cited

U.S. PATENT DOCUMENTS

| | | | |
|---|---|---|---|
| 905,202 | 12/1908 | Mahony et al. | 280/12.14 |
| 1,146,210 | 7/1915 | Steen | 280/12.1 X |
| 1,467,456 | 9/1923 | Silvius | 272/35 |
| 3,391,669 | 7/1968 | Buster | 293/127 X |
| 3,820,790 | 6/1974 | Peterson | 293/127 X |
| 3,885,502 | 5/1975 | Sarno et al. | 273/86 |

FOREIGN PATENT DOCUMENTS

| | | |
|---|---|---|
| 0007250 | 1/1980 | European Pat. Off. . |
| 317930 | 9/1929 | United Kingdom . |
| 380575 | 10/1932 | United Kingdom . |
| 445732 | 3/1936 | United Kingdom . |
| 446428 | 5/1936 | United Kingdom . |
| 523874 | 7/1940 | United Kingdom . |
| 610828 | 11/1948 | United Kingdom . |
| 631193 | 12/1949 | United Kingdom . |
| 722633 | 1/1955 | United Kingdom . |
| 804499 | 11/1958 | United Kingdom . |

*Primary Examiner*—George J. Marlo

*Attorney, Agent, or Firm*—Holman & Stern

[57] ABSTRACT

Apparatus for conducting sports and games on a slippery solid playing area surface comprises one or more doughnut-shaped streamlined discs which include a self-contained propulsion device. Each disc optionally carries an operator and includes around the perimeter thereof a resilient collision bumper. The surface of the playing area comprises a slippery upper layer and a solid underlayer. Each disc, while being supported on the surface upper layer in sliding relationship, is slidingly moved over the surface upper layer by propulsion devices acting relative to the underlayer. Such propulsion can be generated, for example, by electromagnets, motors, jets and the like. Various playing area surface compositions are also disclosed.

9 Claims, 18 Drawing Figures

SURFACE GAME PROJECTILE MANIPULATING DEVICE

This application is a continuation of application Ser. No. 188,129, filed Sept. 17, 1980, now abandoned.

BACKGROUND OF THE INVENTION

This invention relates to sports and organized games, in keeping with contemporary advancement and the modern way of life.

SUMMARY OF THE INVENTION

The main feature of the invention comprises a circular oval shaped or "doughnut shaped" streamlined disc construction with a smooth concave or convex bottomed surface or a one or more wheeled convention vehicle, protected around its periphery by resilient, sponge-rubber or air filled cushioning tire devices or means of a similar nature so s to deaded the impact on collision and to offer protection to the occupant during collision or bumping of two or more of these doughnut shaped discs or vehicles hereinafter referred to as "Discs" and the conception of the game to be referred to as "Skiddies".

BRIEF DESCRIPTION OF THE DRAWINGS

The present invention will now be described in connection with the accompanying drawings in which.

DETAILED DESCRIPTION OF THE INVENTION

Comfortable sitting, 21, is provided for the operator inside the disc and means comprising any one of a conventional, internal combustion engine, electric motor, jet propulsion, ramjet, pulse jet, one or more ducted fans or propellors and power sources of similar description are utilized to provide the requisite power source 23 for propelling or air cushioning said discs, which, preferably, slide over a smooth, frozen, wet, greased or polished glass-like slippery surfaces.

Figure 1:
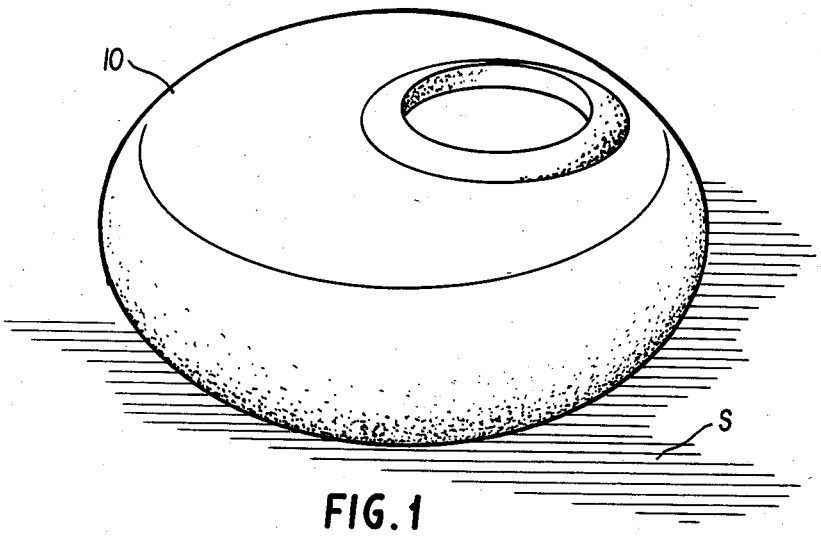
FIG. 1 generally illustrates the exterior of the vehicle of the present invention and the surface on which it skids.
Figure 2:
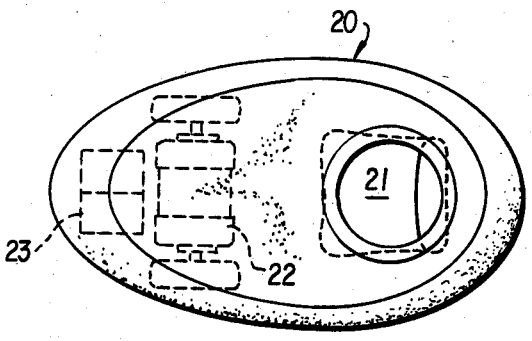
FIG. 2 shows a second embodiment of the vehicle of the present invention embodied in an elliptically shaped exterior.
Figure 3:
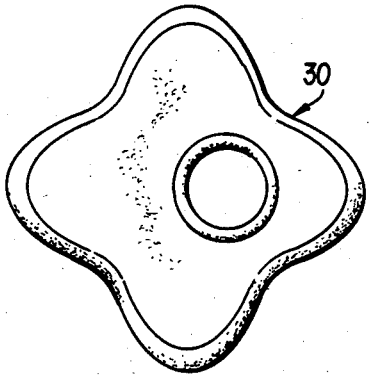
FIG. 3 shows a third embodiment of the vehicle of the present invention embodied in an aster-shaped exterior.
Figure 4:
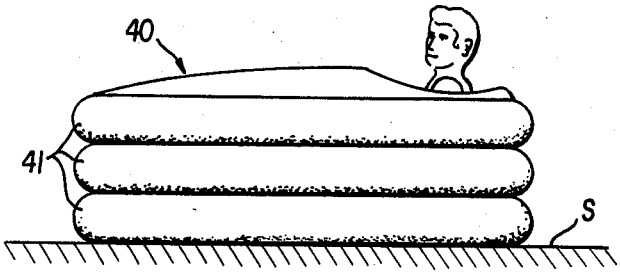
FIG. 4 illustrates a fourth embodiment of the inventive vehicle having a multiple collision-shock-absorbing arrangement.
Figure 5:
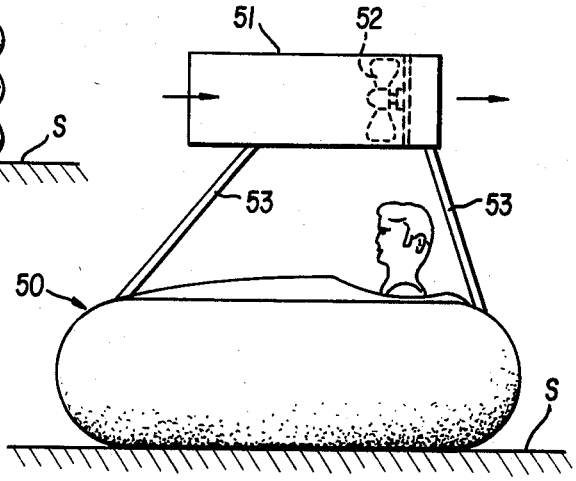
FIG. 5 shows a fifth embodiment of the vehicle of the present invention having overhead propulsion means.

Means are also provided comprising conventional steering frictional or electromagnetic means alone or in conjunction with the jet exhausts or other power source to enable directional control, steering and braking control thereby enabling the discs 10 or 30 in FIG. 3 to slide, skid or slither over the highly greased and/or polished glass-like surface, thus enabling the driver to maneuver these discs for competitive racing, bumping games and such like, for example, by employing a large ball or puck for the purpose of scoring points or goals by two opposing teams, or for racing.

The main chassis is fabricated by known standard engineering methods out of tubing, angular pieces, sheet metal or cast in suitable metals such as magnesium or aluminum alloys.

Around this construction, a rim similar to a car wheel is provided which is capable of accomodating one or more tire like constructions 41, which may be inflatable or similar to tubeless tires, or made out of spongy rubber or plastic material so as to deaden the impact of the colliding discs 40 during their slide over the highly polished or greased glass like slippery surfaces.

Seating accommodation 21 for the driver is well padded inside this disc construction and to enable him by skill to steer and control the movement of this sliding disc vehicle. These discs may further be provided with sliding or hinged transparent covers 40 against inclement weather and painted brilliantly with team colours.

Powers for propulsion may be provided by an internal combustion engine 51, 52 mounted at 53 and/or coupled to wheels provided with a rough, gripping surface or a metal chain or a continuous track (as in army tanks), or magnetic or vacuum suction creating rubber cup-like protubrances on the surface of these tracks or wheels, which can thus "bite" into or make good contact and grip by magnetic attraction the hard surface of the iron, stainless steel sheets or concrete floor plastic or rubber surfaces (greased over), thereby providing the necessary propulsion and enabling the discs 50 to slide over the glass-like slippery surfaces.

Figure 6A:
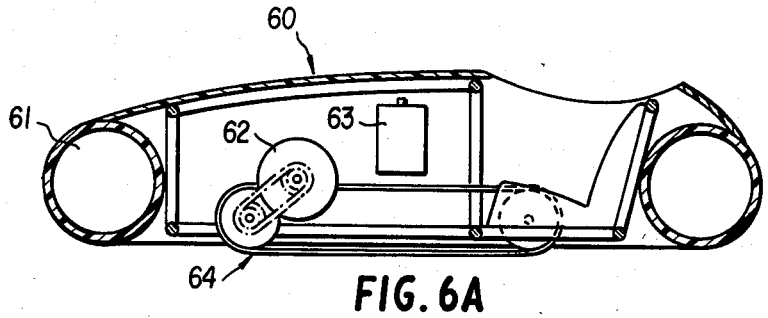
FIG. 6A is a cross-sectional view of the inventive vehicle of FIG. 6B.
Figure 6B:
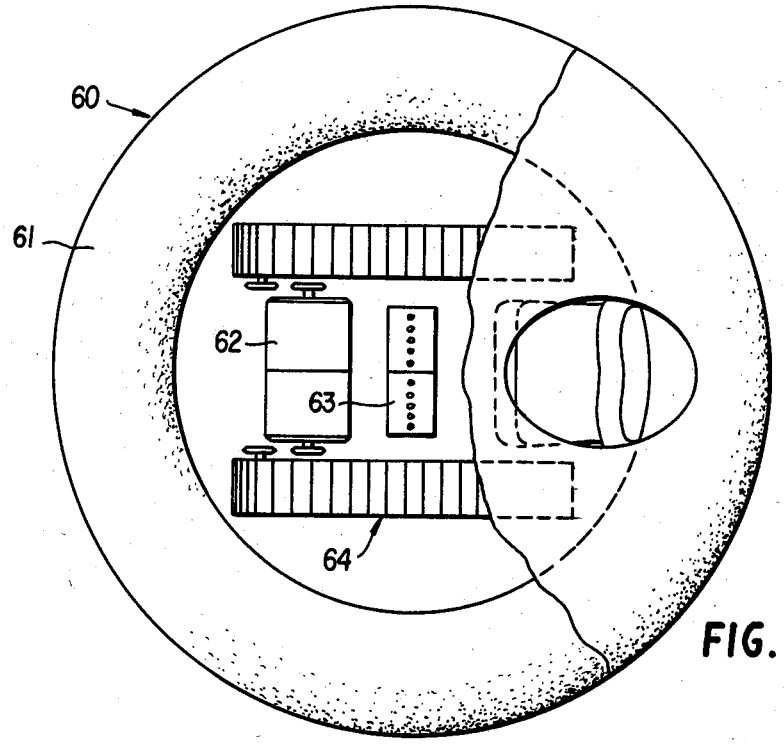
FIG. 6B is a sixth embodiment of the vehicle of the present invention.

It is preferred to employ two continuous tracks 64 as in FIGS. 6A, 6B one on each side of the central axis of the disc 60, and which can be rendered magnetic according to the discretion of the operator. FIG. 6A also shows propulsion motor 62,63 continuous tread 64, 63 electric batteries and 61 the shock absorbing protector.

Another form of propulsion would be by using one or more small jet exhausts, ram-jets, pulse jet motors, or fan propellors (ducted or otherwise), which are placed in such a position rearwardly so as not to be capable of being damaged during the collisions of these discs and can be swivelled to the right or the left over a roller bearing track mounted at the periphery of the main chassis to provide the necessary directional control during the skidding movements of the said discs over the greased slippery surface.

Another alternative is to vary the fuel supply to these propulsion motors. Of course, these discs may be provided with the conventional power mechanism of internal combustion engines, which may also be utilized to charge the electric batteries.

The smooth glass-like skidding or slippery surfaces is constructed by preparing a ferro-concrete foundation, sinking wooden or steel anchoring piles. Upon these wooden or steel metal anchoring piles, wooden or metal cross pieces are mounted over which the iron or steel sheets are fixed and preferably welded together to render a smooth, uniform surface and which is further polished or greased over to provide an excellent skidding surface. Smooth concrete ceramic, glass, plastic or rubber flooring may be employed by greasing or oiling the concrete surface and using a slippery emulsion directly to maintain a glass-like slippery surface.

This concrete, plastic or rubber or sponge rubber matrix may preferably possess very high percentage of powdered iron filings or iron ore in its composition for enabling magnetic steering, braking and propulsion and which will be considered in detail later in the specification.

Figure 9:
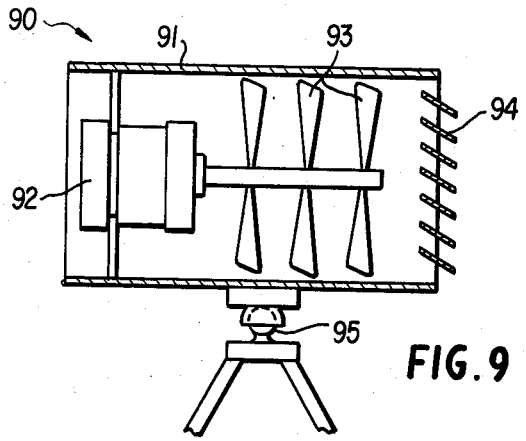
FIG. 9 is a partial sectional view through the overload propulsion means of FIG. 5.

Steering can be effectively employed by the assistance of conventional steering methods as in cars or by swivelling the jet exhaust units or ducted fans 93 in FIG. 9 or by opening or shutting off the fuel supply to each of the jet engines comprising the propelling units.

Figure 10:
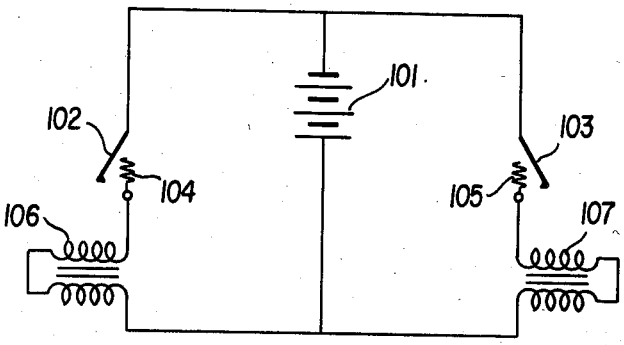
FIG. 10 shows a circuit diagram for operating an electromagnetic propulsion device.
Figure 11:
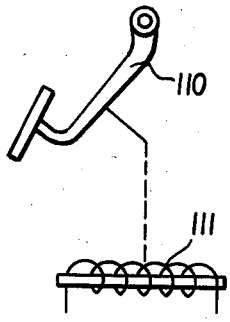
FIG. 11 depicts schematically the arrangement of electromagnetic brake or clutch.
Figure 12:
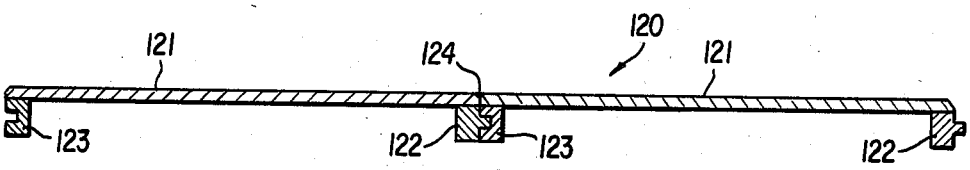
FIG. 12 is a cross-sectional view of one form of the playing surface.
Figure 13:
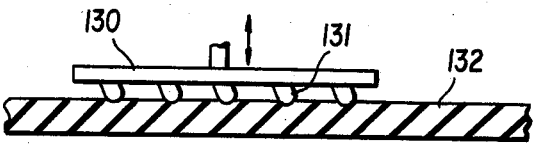
FIG. 13 is a view of the interaction between "blunt" transaction members and a plastic or magnetic surface.
Figure 14:
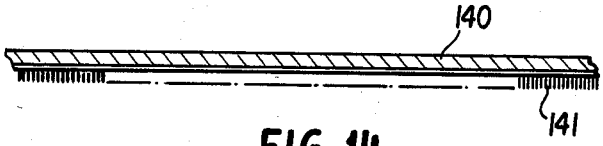
FIG. 14 shows an artificial or natural grass surface.
Figure 15:
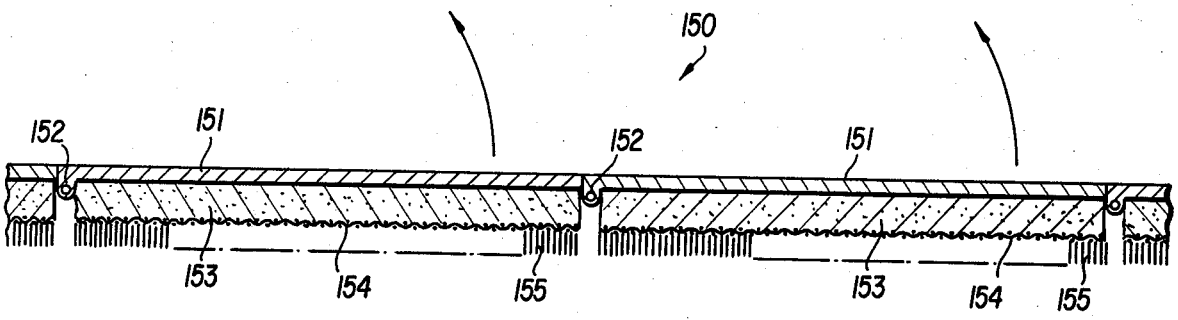
FIG. 15 shows a reversible playing surface.

Another method is to provide a soft iron surface coupled to a magnetic flux creating coil unit 111 capable of being energized by pedal 110 from an accumulator battery or a similar electric current source as shown in FIGS. 10 and 11. Thereby, these iron surfaces or pole pieces can be altered into extremely strong electromagnets by pressing a button controlling the supply of the electric current to the magnet coils.

These said magnetic surfaces 64 as indicated in FIGS. 6A, 6B, 7 and 8 being conveniently positioned to the right and left of the main axis of the disc, can thus be converted into very strong magnets instantaneously.

It can thus be visualized as shown in FIG. 10 that whenever any of the said magnets 106, 107 are energized, From battery 101 and switches 102, 103 it will become an extremely strong magnet and create a braking or frictional tendency with the sheet iron or stainless steel floor of the greased, slippery, highly specially prepared surface, and if this magnetically created track moves forward, the disc owing to the magnetic attraction will move forward and veer to one side or the other depending on which half of the moving track or portion of the disc has been rendered a magnet, and when both the magnetic surfaces of the disc are energized in unison, a forward movement or if required a braking effect will be created.

Of course, two similarly placed frictional surfaces on the disc and caable of reacting against the slippery floor may be used, and which can be lowered mechanically by employing suitable leverage to press against the slippery glass-like floor surface.

Figure 7:
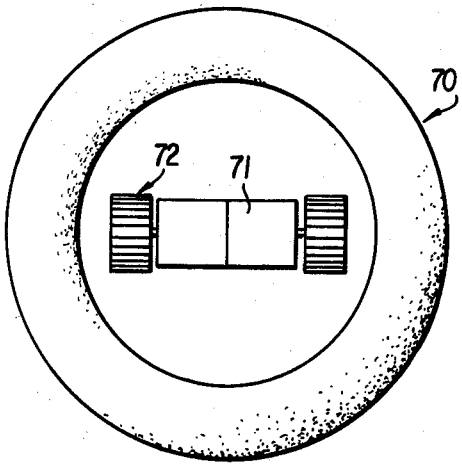
FIG. 7 shows a seventh embodiment of the vehicle of the present invention.
Figure 8:
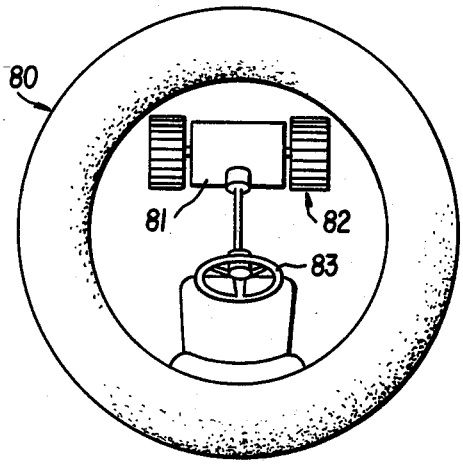
FIG. 8 shows an eighth embodiment of the vehicle of the present invention.

Alternatively, the wheel 82, 72 used for propulsion is in FIGS. 7 and 8, these may be capable of being rendered magnetic and used for steering purposes. When it is intended to utilize electric power for the purpose of propelling these discs, instead of using the well-known electrified dangerous overhead matting, the skidding surface is made out of alternate strips of metal, say about a foot in width and separated from one another by an insulating surface so as not to affect the smooth uniformity of the slippery surface, each of the metal strips being supplied with low voltage, for example, 12-volts. Sliding wheels or surfaces coupled to the disc can thus pick up the necessary current for the electric motors used for propelling these discs. The low voltage thus eliminates the danger of shock or electrocution in the event of an accident. Electric batteries may be used instead.

The slippery, sliding surface may be flat in the form of a level track or area, concave or convex shaped, round or in the form of oval areas, and flanked by a protective low wall barrier and netting arrangement to prevent the discs when sliding at high speeds to jump over and be projected amongst the spectators.

The arena may be preferably covered to shelter against inclement weather and reduce the noise nuisance by using modern constructional methods.

Guide rails may also be provided to enable conversion to a grass pitch by wheeling vehicles or trolloys provided with grass turf over the slippery surface or vice versa by portable interlocking sections or tiles.

Figure 16:
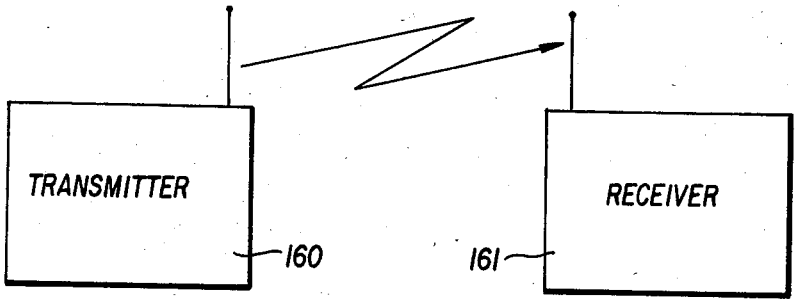
FIG. 16 generally shows the remote control apparatus contemplated for use with this invention.
Figure 17:
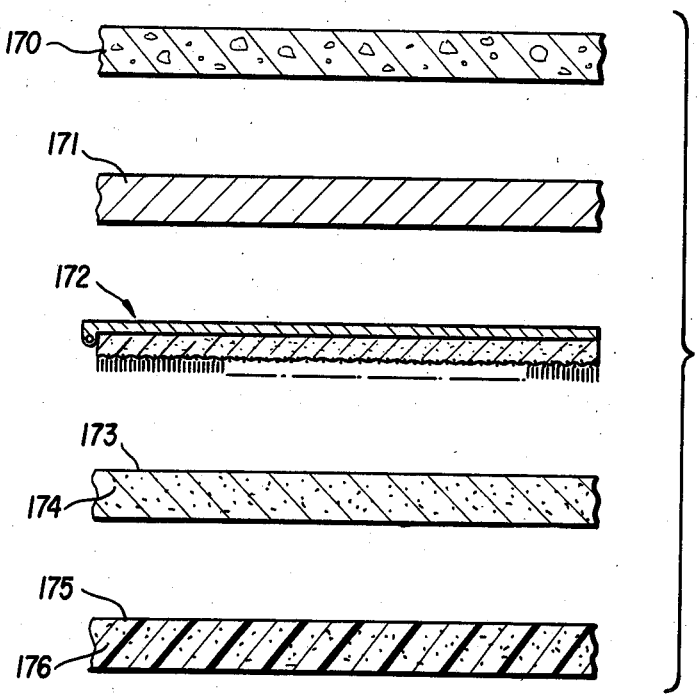
FIG. 17 shows various playing surfaces employed in this invention.

Moreover, the said discs may be remotely controlled by radio as shown in FIG. 16 by the incorporation of known radio controlled steering and conventional engine control mechanisms from 160. Each disc may be allocated a separate radio frequency, which may also be used for communication. The discs may thus be remotely controlled by members of two teams equipped with receivers or several players for racing or other competitions.

A large circular ball or a puck may be used when two or several teams compete by scoring goals as in various football (soccer) games. A separate disc may be used by an umpire who will thus be always on the spot to judge any infringements as he is bumped about two opposing teams endeavouring to score goals.

It is quite evident that several games can be easily devised without in any way departing from the fundamental features of the invention.

In the methods of propelling the vehicle by forced air described above (jet, ducted fan, etc.) it is a preferred embodiment that the propulsion means and the operator's seat be mounted cooperatively. Thus, for example, the propulsion means and the operator's seat could both rotate simultaneously or could both be fixedly mounted on a rotating element, such as a rotary turret. The mounting could be on conventional roller bearings. This would permit the operator always to face the direction the vehicle is moving and would maintain a constant relative position between the operator and the propulsion means.

FIG. 9 indicates a ducted fan 90 for propulsion, 92 the electric motor, 91 the duct housing enclosing fan blades 93 and 94 the exhaust control from the jet air from the ducted fan. 95 is the universal joint for directional control of jet.

I claim:

1. Apparatus for sports and games comprising:

a defined playing area upon which the sports and games are conducted comprising a smooth surface defining a slippery and level upper layer and a solid under layer, said under layer being at least partially composed of iron, said playing area being enclosed by a protective barrier;

at least one self-powered vehicle having a generally circular or oval configuration and a bottom resting on and capable of sliding on said slippery upper layer;

a resilient collision bumper extending completely around the perimeter of said vehicle;

propelling and steering means, acting relative to said under layer, for unidirectionally propelling and steering said vehicle as said bottom slides upon said upper layer, said propelling and steering means being controllable by an operator and being carried by said vehicle substantially centrally thereof, said steering means comprising at least one electromagnetic wheel mounted at the bottom of the vehicle, capable of magnetically interacting with the playing area.

2. The apparatus of claim 1 wherein each vehicle is large enough to carry a human operator and further comprises a protected seating means for an operator within the vehicle.

3. The apparatus of claim 2 wherein there are a plurality of said vehicles, each vehicle being painted brilliantly with a team color.

4. The apparatus of claim 2 wherein the playing area comprises a ferro-concrete foundation consisting of wooden or steel anchoring piles, wooden or metal cross-pieces mounted over the piles, iron or steel sheets fixed to the cross-pieces, and a conductive coating of ceramic, glass, plastic, rubber, or like material on top of the sheets to afford a smooth, glass-like, and slippery surface.

5. The apparatus of claim 2 wherein the bumper is sponge rubber or an air-filled tire-like tube, so as to permit the vehicle to collide and bounce off the playing area protective barrier or another vehicle.

6. The apparatus of claim 2 employing at least one vehicle on the defined playing area.

7. The apparatus of claim 2 wherein remote control means are afforded for the vehicle.

8. The apparatus of claim 2 wherein two electromagnetic wheeled tracks are afforded, one on each side of the vehicles central axis.

9. The apparatus of claim 8 wherein the iron composed in said under layer is afforded by including a high percentage of powdered iron in its composition.

* * * * *